US009908727B2

(12) United States Patent
Iwami et al.

(10) Patent No.: US 9,908,727 B2
(45) Date of Patent: Mar. 6, 2018

(54) SHEET CONVEYANCE APPARATUS AND IMAGE FORMING APPARATUS

(71) Applicant: CANON KABUSHIKI KAISHA, Tokyo (JP)

(72) Inventors: Shingo Iwami, Tokyo (JP); Hiroshige Inoue, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/208,798

(22) Filed: Jul. 13, 2016

(65) Prior Publication Data

US 2017/0029231 A1 Feb. 2, 2017

(30) Foreign Application Priority Data

Jul. 27, 2015 (JP) ..... 2015-147579

(51) Int. Cl.
*B65H 5/00* (2006.01)
*B65H 5/36* (2006.01)
(Continued)

(52) U.S. Cl.
CPC ..... *B65H 5/36* (2013.01); *B65H 5/062* (2013.01); *B65H 5/26* (2013.01); *G03G 15/6529* (2013.01);
(Continued)

(58) Field of Classification Search
CPC . B65H 5/00; B65H 5/062; B65H 5/26; B65H 5/36; B65H 5/38; B65H 29/40;
(Continued)

(56) References Cited

U.S. PATENT DOCUMENTS 5,358,230 A 10/1994 Ikemori et al.
5,485,991 A 1/1996 Hirano et al.
(Continued)

FOREIGN PATENT DOCUMENTS

CN 202481789 U 10/2012
CN 103052578 A 4/2013
(Continued)

OTHER PUBLICATIONS

Nov. 27, 2017 Chinese Official Action in co-pending Chinese Patent Application No. 201610589988.9 (with English translation).

*Primary Examiner* — Prasad V Gokhale
(74) *Attorney, Agent, or Firm* — Fitzpatrick, Cella, Harper & Scinto

(57) ABSTRACT

A sheet conveyance apparatus includes a first conveyance unit conveying a sheet, the first conveyance unit including a first rotary member, and a second rotary member contacting with the first rotary member at a contact portion, a second conveyance unit arranged downstream, in a sheet conveyance direction, of the first conveyance unit, a bent conveyance guide forming a sheet conveying path between the first conveyance unit and the second conveyance unit such that the sheet conveying path is bent, and a swing guide provided upstream, in the sheet conveyance direction, of the bent conveyance guide, and guiding the sheet to the bent conveyance guide at a downstream side, in the sheet conveyance direction, of the contact portion. A center of rotation of the swing guide is provided coaxially as a rotation axis of the first rotary member.

12 Claims, 9 Drawing Sheets

(51) Int. Cl.
*G03G 15/00* (2006.01)
*B65H 5/06* (2006.01)
*B65H 5/26* (2006.01)

(52) U.S. Cl.
CPC ..... *G03G 15/6552* (2013.01); *B65H 2404/63* (2013.01); *G03G 2215/00679* (2013.01)

(58) Field of Classification Search
CPC ..... B65H 29/60; B65H 2402/31; B65H 2404/144; B65H 2404/63; B65H 2404/632; B65H 2404/633; B65H 2404/65
See application file for complete search history.

(56) References Cited

U.S. PATENT DOCUMENTS

| | | | | |
|---|---|---|---|---|
| 5,793,399 | A | 8/1998 | Kawakami et al. | |
| 5,867,196 | A | 2/1999 | Kiyohara et al. | |
| 5,886,729 | A | 3/1999 | Hiramatsu et al. | |
| 6,095,515 | A | 8/2000 | Kiyohara et al. | |
| 6,131,899 | A | 10/2000 | Nojima et al. | |
| 8,135,320 | B2 | 3/2012 | Matsumoto et al. | |
| 8,292,293 | B2 | 10/2012 | Inoue | |
| 8,480,081 | B2 | 7/2013 | Inoue | |
| 8,550,456 | B2 | 10/2013 | Hirota et al. | |
| 8,867,980 | B2 | 10/2014 | Inoue | |
| 9,085,432 | B2 | 7/2015 | Hiyama | |
| 9,388,003 | B2 * | 7/2016 | Harada | B65H 5/062 |
| 2008/0145128 | A1 * | 6/2008 | Lee | B65H 5/062 400/630 |
| 2009/0212493 | A1 * | 8/2009 | Sugahara | B65H 29/52 271/272 |
| 2010/0301546 | A1 * | 12/2010 | Ninomiya | B65H 5/062 271/253 |
| 2015/0115526 | A1 * | 4/2015 | Harada | B65H 5/062 271/228 |
| 2015/0137443 | A1 * | 5/2015 | Yamamoto | B65H 85/00 271/3.2 |
| 2015/0338786 | A1 * | 11/2015 | Sawada | G03G 15/161 399/401 |
| 2016/0340135 | A1 * | 11/2016 | Lee | B65H 5/26 |

FOREIGN PATENT DOCUMENTS

| | | | |
|---|---|---|---|
| JP | 2007-131455 | A | 10/2006 |
| JP | 2007-131455 | A | 5/2007 |
| JP | 2007-147712 | A | 6/2007 |
| JP | 2010-061060 | A | 3/2010 |
| JP | 2011-205463 | A | 10/2011 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus conveying sheets, and an image forming apparatus having the sheet conveyance apparatus.

Description of the Related Art

Various types of sheets are used in image forming apparatuses such as printers and copying machines in accordance with various purposes. Meanwhile, there are demands to suppress a curvature of a bent portion in a sheet conveyance path as much as possible, so that normal paper can be conveyed through the conveyance path, and the increase in size of the apparatus can be prevented, from the viewpoint of downsizing the apparatus.

Japanese unexamined patent application publication No. 2007-131455 proposes a recording medium feeding device including an inner guide member and an outer guide member composing a bent conveyance path, wherein a portion of the inner guide member is composed of a swingable movable guide. The movable guide moves in a direction moving away from the outer guide member by the force received from a fed sheet (specifically, a thick paper), reducing the conveyance resistance of the sheets.

The movable guide disclosed in Japanese unexamined patent application publication No. 2007-131455 is supported swingably on the fixed inner guide, and a cutout is formed on the movable guide so as not to interfere with one of roller pairs provided downstream, in a sheet conveyance direction, of the movable guide. When the movable guide is pressed by the sheet and swings, the distance between one of the roller pairs and the cutout is narrowed.

That is, in a state where the movable guide is not pressed by the sheet, a sufficient gap must be formed between the movable guide and one of the roller pairs so as to allow swinging of the movable guide. Therefore, when a thin paper with a small stiffness is fed, the movable guide will not swing even when the fed thin paper contacts the movable guide, and the sheet may be caught in the gap, causing jamming or damaging of the sheet. Especially if the leading edge of the thin paper is curled, or if the whole body of the thin paper is waved, the thin paper is likely to be caught in the gap, causing jamming and other problems.

SUMMARY OF THE INVENTION

According to a first aspect of the present invention, a sheet conveyance apparatus includes a first conveyance unit conveying a sheet, the first conveyance unit including a first rotary member, and a second rotary member conveying the sheet at a contact portion in contact with the first rotary member, a second conveyance unit arranged downstream, in a sheet conveyance direction, of the first conveyance unit, and conveying the sheet, a bent conveyance guide forming a sheet conveying path between the first conveyance unit and the second conveyance unit such that the sheet conveying path is bent, and a swing guide provided upstream, in the sheet conveyance direction, of the bent conveyance guide, and guiding the sheet to the bent conveyance guide at a downstream side, in the sheet conveyance direction, of the contact portion. A center of rotation of the swing guide is provided coaxially as a rotation axis of the first rotary member.

According to a second aspect of the present invention, a sheet conveyance apparatus includes a first conveyance unit conveying a sheet, the first conveyance unit including a rotation shaft, and a first rotary member rotating around the rotation shaft, a second rotary member conveying the sheet at a contact portion in contact with the first rotary member, a second conveyance unit arranged downstream, in a sheet conveyance direction, of the first conveyance unit, and conveying the sheet, a bent conveyance guide forming a sheet conveying path between the first conveyance unit and the second conveyance unit such that the sheet conveying path is bent, a swing guide provided upstream, in the sheet conveyance direction, of the bent conveyance guide, and guiding the sheet to the bent conveyance guide at an upstream side and a downstream side, in the sheet conveyance direction, of the contact portion, the swing guide defining an opening through which the first rotary member is in contact with the second rotary member, and an attaching portion attaching the swing guide swingably to the rotation shaft.

Further features of the present invention will become apparent from the following description of exemplary embodiments with reference to the attached drawings.

DESCRIPTION OF THE EMBODIMENTS

First Embodiment

Figure 1:
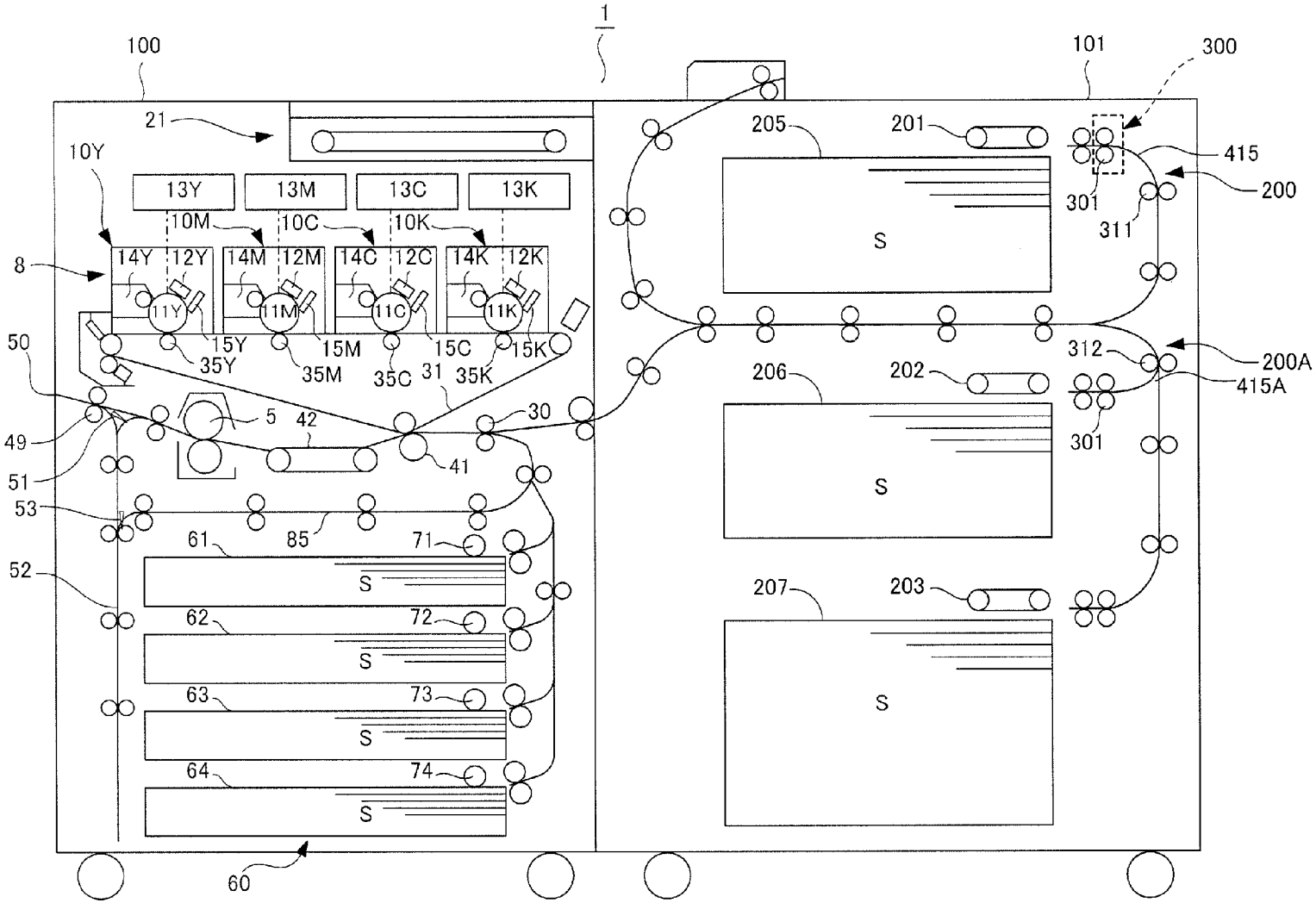
FIG. 1 is a schematic diagram illustrating a whole body of a printer according to a first embodiment.
Figure 2:
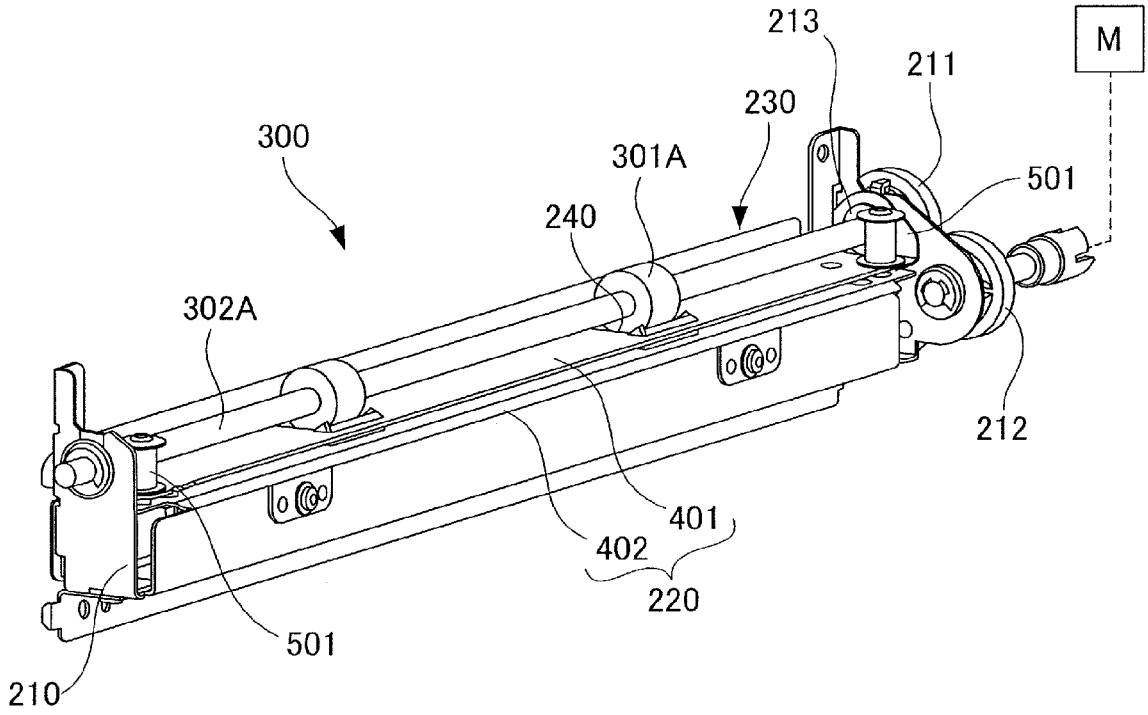
FIG. 2 is a perspective view of a roller unit.

At first, a first embodiment of the present invention will be described. A printer 1, i.e., image forming apparatus, according to a first embodiment is an electro-photographic laser beam printer that forms a four-color toner image. The printer 1 includes, as illustrated in FIG. 1, a printer body 100, and a paper deck 101 arranged adjacent to the printer body 100. The printer body 100 includes a cassette sheet feeding unit 60, an image forming unit 8 forming an image on a sheet, and a reader unit 21 arranged above the image forming unit 8.

The cassette sheet feeding unit 60 includes four layers of cassettes 61, 62, 63 and 64 on which sheets S are supported, and feed rollers 71, 72, 73 and 74 provided to correspond to the respective cassettes 61, 62, 63 and 64. The sheets S supported on the cassettes 61, 62, 63 and 64 are fed by the feed rollers 71, 72, 73 and 74 toward the image forming unit 8.

The paper deck 101 includes three layers of cassettes 205, 206 and 207 on which the sheets S are supported, and attracting-conveying portions 201, 202 and 203 that attract and feed the sheets S supported on the cassettes 205, 206 and 207. The paper deck 101 further includes a sheet conveyance apparatus 200 conveying a sheet S fed via the attracting-conveying portion 201 toward the printer body 100.

When an image forming command is output to the printer 1, an image forming process by the image forming unit 8 is started based on an image information entered from an external computer and the like connected to the printer 1 or an image information read via the reader unit 21. The image forming unit 8 includes four scanner units 13Y, 13M, 13C and 13K, and four process cartridges that form images of four colors, which are yellow (Y), magenta (M), cyan (C) and black (K). The four process cartridges 10Y, 10M, 10C and 10K adopt the same configuration, except for the difference in the colors of the image being formed, so that in the present description, only the image forming process of the process cartridge 10Y will be described, and the descriptions of process cartridges 10M, 10C and 10K will be omitted.

The scanner unit 13Y irradiates laser beams toward a photosensitive drum 11Y of the process cartridge 10Y based on the entered image information. At this time, the photosensitive drum 11Y is charged in advance by a charging unit 12Y, and by having laser beams irradiated thereto, an electrostatic latent image is formed on the photosensitive drum 11Y. Thereafter, the electrostatic latent image is developed by a developer 14Y, and a yellow (Y) toner image is formed on the photosensitive drum 11Y.

Similarly, magenta (M), cyan (C) and black (Bk) toner images are formed on the photosensitive drums of process cartridges 10M, 10C and 10K. The toner images of respective colors formed on the respective photosensitive drums are transferred via primary transfer rollers 35Y, 35M, 35C and 35K to the intermediate transfer belt 31, and conveyed via the rotating intermediate transfer belt 31 to a secondary transfer roller 41. The image forming processes of respective colors are performed at matching timings so that the image is overlapped with a primarily transferred toner image formed upstream on the intermediate transfer belt 31. Further, the toner remaining on the photosensitive drums 11Y, 11M, 11C and 11K after the of toner images have been transferred is recovered by cleaning members 15Y, 15M, 15C and 15K.

Simultaneously as the above-described image forming operation, the sheets stored in the cassette sheet feeding unit 60 or the sheets S supported in the paper deck 101 are conveyed one by one toward a registration roller 30. Then, a toner image formed on the intermediate transfer belt 31 is transferred via the secondary transfer roller 41 to the sheet S conveyed at a predetermined conveyance timing by the registration roller 30. The sheet S on which the toner image has been transferred is conveyed via an intermediate conveyance belt 42 to the fixing unit 5. There, heat and pressure is applied by the fixing unit 5 to the sheet S to fix the toner image, and the sheet S is discharged via a discharge roller pair 49 through a discharge port 50 to an exterior of the apparatus.

When forming images on both sides of a sheet, the sheet having an image formed on a first surface by the secondary transfer roller 41 is guided toward a reverse conveyance path 52 by a switching member 51. The sheet guided to the reverse conveyance path 52 is subjected to switch-back, and guided via a switching member 53 to a duplex conveyance path 85. Then, the sheet is conveyed again to the registration roller 30, where an image is formed on a second surface of the sheet by the secondary transfer roller 41, and then the sheet is discharged through the discharge port 50 to the exterior of the apparatus.

Next, the sheet conveyance apparatus 200 of the paper deck 101 will be described. As illustrated in FIG. 1, the sheet conveyance apparatus 200 includes a roller unit 300, and a downstream conveyance roller pair 311, i.e., second conveyance unit, arranged downstream, in a sheet conveyance direction, of the roller unit 300. Further, the sheet conveyance apparatus 200 includes a bent conveyance guide pair 415 formed in a bent shape toward the sheet conveyance direction and guiding sheets to the downstream conveyance roller pair 311. In the present embodiment, the bent conveyance guide pair 415 is bent in an arc shape, but as long as the bent conveyance guide pair is bent in the sheet conveyance direction, the shape of the guide pair is not restricted to an arc shape, and the shape can be a corner, for example.

As illustrated in FIGS. 2, 3A, 3B and 4A, the roller unit 300 includes a frame member 210, i.e., supporting portion, a drive shaft 302A, a driven shaft 302B, a drive roller 301A, a driven roller 301B, a conveyance guide pair 220, and a motor M. The frame member 210 is fixed to a frame of the paper deck 101 not shown, and the drive shaft 302A, i.e., rotation shaft, and the driven shaft 302B respectively extending in an axial direction orthogonal to the sheet conveyance direction are rotatably supported on the frame member 210.

The driver roller 301A, i.e., first rotary member, is fixed to the drive shaft 302A, and a driven roller 301B, i.e., second rotary member, is rotatably fixed to the driven shaft 302B. Further, a first gear 211 fixed to the drive shaft 302A and a second gear 212 meshed with the first gear 211 are rotatably supported on the frame member 210. A motor M as driving source is connected to the second gear 212, and by driving the motor M, the drive roller 301A is rotated via the second gear 212, the first gear 211 and the drive shaft 302A.

The driven roller 301B is supported on the frame member 210 in a relatively movable manner with respect to the drive roller 301A, and the driven roller is biased by a biasing member 511 (refer to FIG. 4A), such as a spring, toward the drive roller 301A. Thereby, the driven roller 301B contacts the drive roller 301A to form a nip N, i.e., contact portion, and is driven to rotate along with the rotation of the drive roller 301A. The drive shaft 302A, the driven shaft 302B, the drive roller 301A and the driven roller 301B constitute an upstream conveyance unit 230, i.e., first conveyance unit, conveying a sheet to the downstream conveyance roller pair 311.

In the present embodiment, the number of drive rollers 301A and driven rollers 301B respectively mounted on the drive shaft 302A and the driven shaft 302B is two each, but the number can be one, or three or more. In the following description, the circumferential configuration of only one of the two driver rollers 301A and one of the driven rollers 301B is described, but the same description applies for the other roller, the detailed description of which is omitted.

The conveyance guide pair 220 is composed of a lower guide 402, i.e., opposing guide, fixed to the frame member 210, and an upper guide 401, i.e., swing guide, relatively rotatably supported on the drive shaft 302A, i.e., pivot center. That is, one of the conveyance guide pair 220 is the upper guide 401 functioning as the swing guide, and the other one of the conveyance guide pair 220 is the lower guide 402 functioning as the fixed guide. The upper guide 401 is formed continuously from upstream to downstream of the nip N in the sheet conveyance direction. The upper guide 401 is designed to guide the sheet at a position corresponding to the drive roller 301A in an axial direction X (refer to FIG. 2) of the drive shaft 302A. That is, if the drive roller 301A and the upper guide 401 are projected on the conveyance plane, i.e., plane including the axial direction X and a conveyance direction Y of the sheet, the drive roller 301A and the upper guide 401 are overlapped in the conveyance direction Y. Further, the upper guide 401 is disposed on an outer side than the lower guide 402 in the bending direction of the bent conveyance guide pair 415.

The upper guide 401 is attached to the drive shaft 302A via a bearing 213, i.e., attaching portion. The upper guide 401 is biased toward the lower guide 402 via guide pressing members 501 and 501, i.e., biasing portions, formed of springs, and guide gap regulation members 531 and 531, i.e., retaining portions, are provided between the upper guide 401 and the lower guide 402. The guide gap regulation members 531 contact the upper guide 401 biased by the guide pressing members 501, and retain the upper guide 401 with a predetermined gap, i.e., guide gap, between the upper guide and the lower guide 402. Thus, the gap between the upper guide 401 and the lower guide 402 is constantly ensured to allow conveyance of sheets.

Figure 3A:
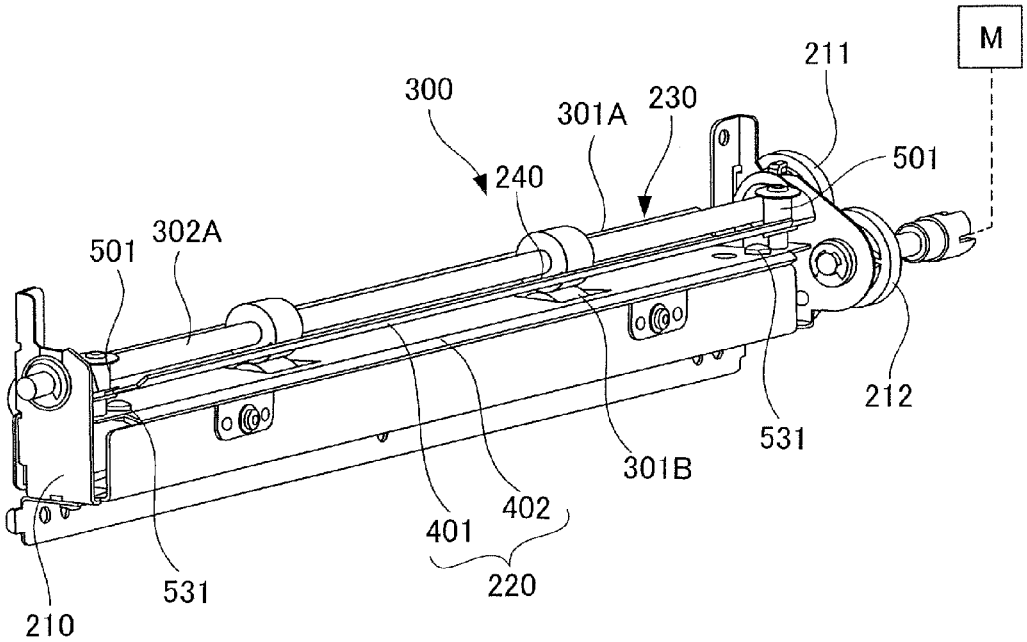
FIG. 3A is a perspective view of a roller unit in a state where an upper swing guide is swung, seen from a front side.
Figure 3B:
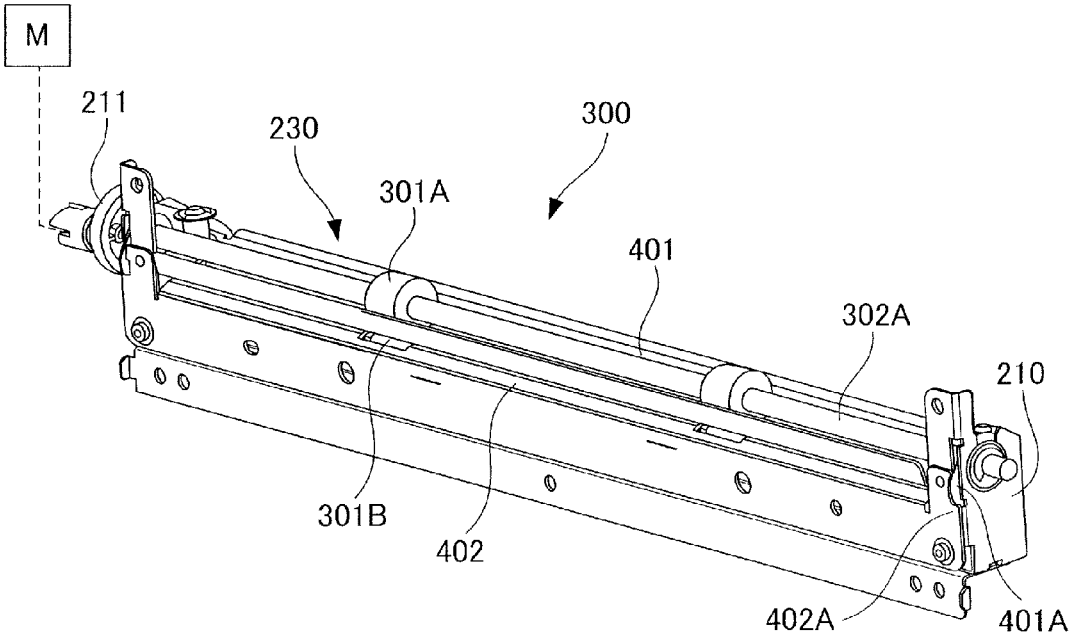
FIG. 3B is a perspective view of a roller unit in a state where an upper swing guide is swung, seen from a rear side.

As illustrated in FIG. 3B, the frame member 210 includes a contact portion 402A in contact with a convex portion 401A provided to the upper guide 401, restricting a maximum opening of the upper guide 401. Thereby, a lower end position of the guide surface on the upstream side than the nip N of the upper guide 401 in the sheet conveyance direction is restricted, and the gap formed between the upper guide 401 and the lower guide 402 can be constantly ensured to allow conveyance of sheets.

Further, the upper guide 401 includes opening portions 240 through which a portion of an outer circumference surface of the drive rollers 301A protrude downward, and a guide surface 401*a* (refer to FIGS. 4A and 4B) positioned downstream, in the sheet conveyance direction, of the nip N that guides sheets. The opening portions 240 are not restricted to holes, and can be cutouts. The drive rollers 301A contact the driven rollers 301B through the opening portion 240.

Figure 4A:
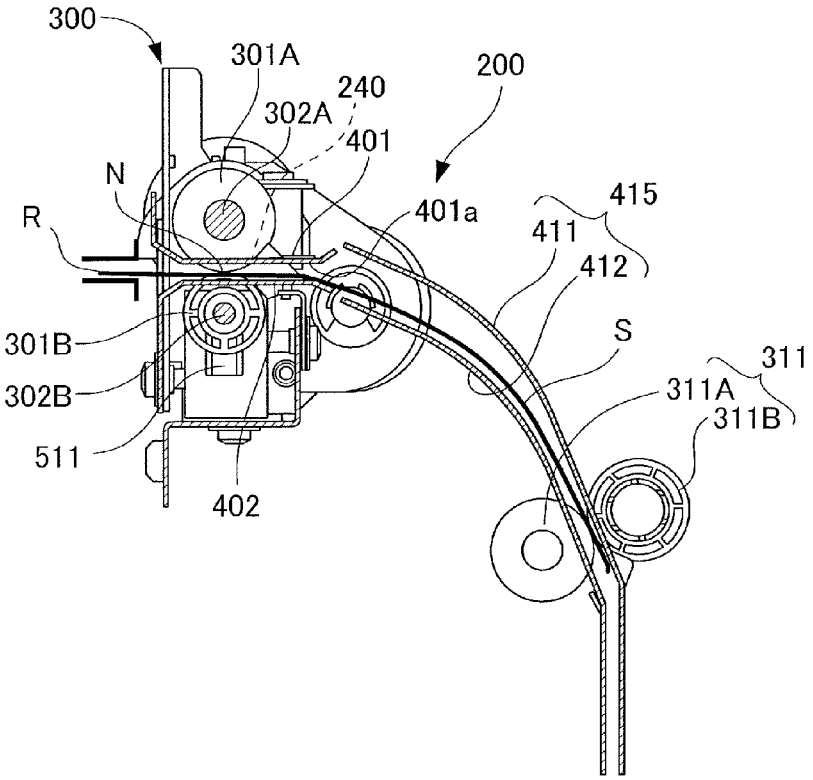
FIG. 4A is a cross-sectional view of a sheet conveyance apparatus in a state where the upper guide is not swung.

Next, a conveyance operation of the sheets and a swing movement of the upper guide 401 will be described with reference to FIGS. 4A and 4B. It is assumed that a thick paper (having a basis weight of 300 g/m$^2$ or greater, for example) is used as the sheet S.

The sheet S fed via the attracting-conveying portion 201 is conveyed via the drive roller 301A and the driven roller 301B toward the bent conveyance guide pair 415 composed of an outer guide 411 and an inner guide 412. At that time, the upper guide 401 is pressed against the guide gap regulation member 531 by the guide pressing member 501, and the gap between the upper guide 401 and the lower guide 402 is maintained so that sheets can be conveyed.

Figure 4B:
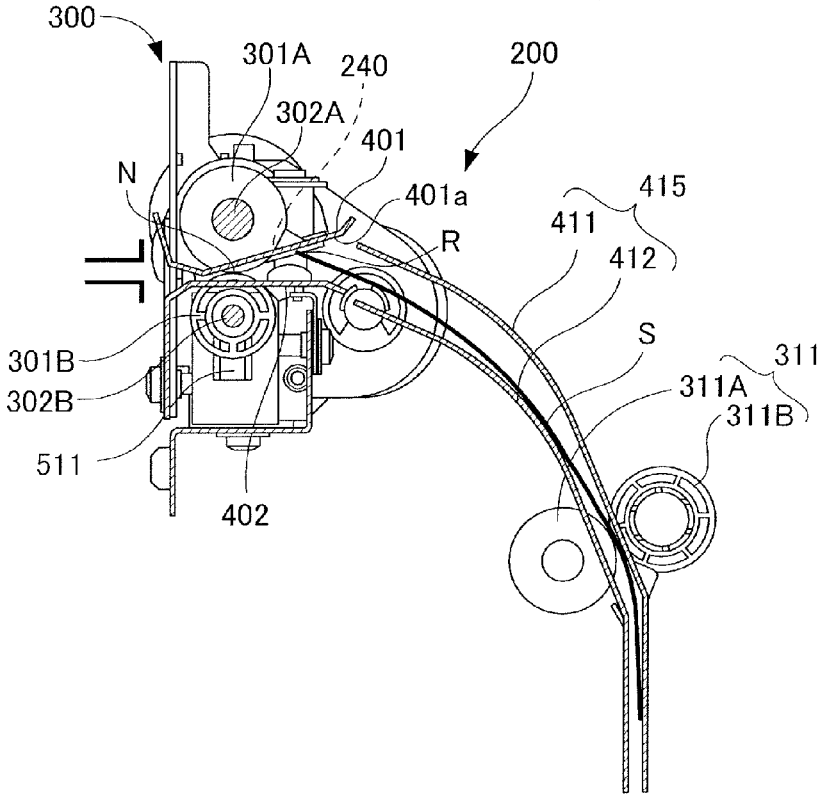
FIG. 4B is a cross-sectional view of a sheet conveyance apparatus in a state where the upper guide is swung.

As illustrated in FIG. 4B, the sheet S is guided via the bent conveyance guide pair 415 to a downstream drive roller 311A and a downstream driven roller 311B composing the downstream conveyance roller pair 311, and a trailing edge of the sheet S passes the nip N. At this time, conveyance force is applied only from the downstream conveyance roller pair 311 to the sheet S. Since the sheet S is in a restrained state by the bent conveyance guide pair 415, conveyance resistance is increased.

Especially, when a trailing edge R of the sheet S passes the nip N, the trailing edge R of the sheet S that has become a free end presses the guide surface 401*a* of the upper guide 401 upward by the stiffness of the sheet S. The upper guide 401 swings upward by the pressing force, opposing to the biasing force of the guide pressing member 501. Thereby, the sheet S will have smaller curvature corresponding to the upward swinging movement of the upper guide 401, and the increase of conveyance resistance caused by the stiffness of the sheet S can be reduced.

Moreover, since the upper guide 401 is supported by the drive shaft 302A via the bearing 213 that allows relative rotation of the upper guide, the gap between the outer circumference surface of the drive roller 301A and the opening portion 240 formed on the upper guide 401 will not be varied greatly even when the upper guide 401 swings. The gap between the outer circumference surface of the drive roller 301A and the opening portion 240 can be minimized, and jamming or damaging of the sheet caused by the sheet being caught in the gap can be prevented. The distance between the upstream end of the opening portion 240 in the sheet conveyance direction and the drive shaft 302A should preferably be equal to the distance between the downstream end of the opening portion 240 in the sheet conveyance direction and the drive shaft 302A.

Further, the upper guide 401 is formed contiguously from upstream to downstream side of the nip N in the sheet conveyance direction, so that a smooth guide surface is formed guiding the sheet from upstream to downstream of the nip N, and the sheet can be guided securely without being caught.

According to the present embodiment, a spring pressure of the guide pressing members 501 and 501 is set so that the upper guide 401 will not swing when a thin paper is conveyed but the upper guide 401 will swing when a thick paper (with a basis weight of 300 g/m2 or greater, for example) is conveyed, but the preset invention is not restricted thereto. The spring pressure of the guide pressing members 501 and 501 can be set arbitrarily in accordance with the curvature of the bent conveyance guide pair 415 or the basis weight of the sheet being conveyed.

According further to the present embodiment, the upper guide 401 is supported on the drive shaft 302A via the bearing 213 that allows relative rotation of the upper guide, but the upper guide is not necessarily supported on the drive shaft 302A, as long as the upper guide is supported rotatably on a same rotation axis as the drive shaft 302A. That is, the center of rotation of the upper guide 401 should be provided coaxially as the drive shaft 302A. For example, the upper guide 401 can be supported swingably on a different frame member. According to the present embodiment, the upper guide 401 is attached to the drive shaft 302A via the bearing 213, i.e., attaching portion, but the present invention is not restricted thereto. For example, it is possible to form an opening to the upper guide 401, and use the opening as the attaching portion for attaching the upper guide 401 to the drive shaft 302A.

First Modified Example

Figure 5:
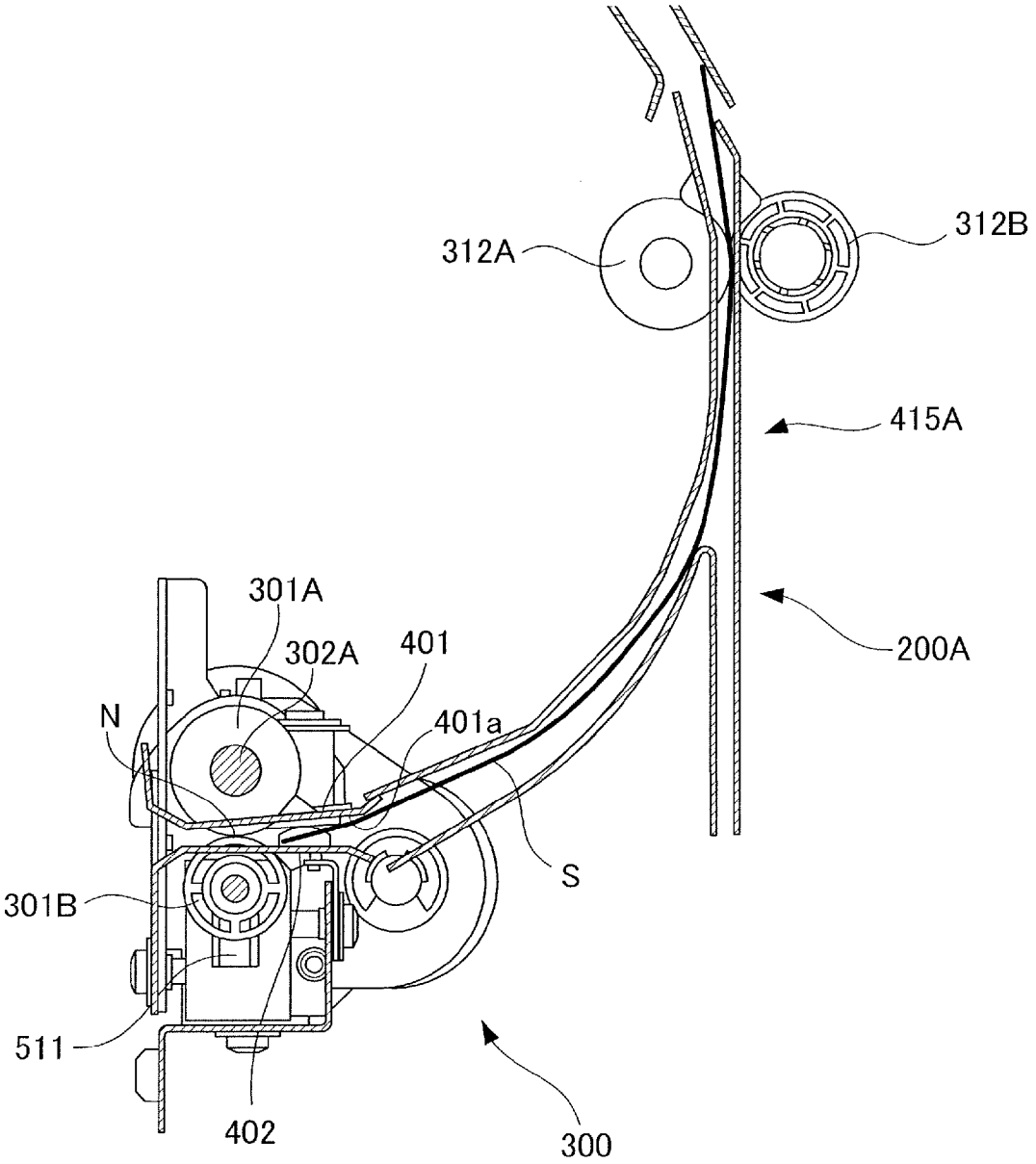
FIG. 5 is a cross-sectional view of a sheet conveyance apparatus according to a first modified example.

In the first embodiment described above, the bent conveyance guide pair 415 is bent downward with respect to the drive roller 301A and the driven roller 301B, but the present invention is not restricted thereto. That is, as illustrated in FIGS. 1 and 5, the sheet conveyance apparatus 200A can adopt a configuration where the bent conveyance guide pair 415A is bent upward with respect to the drive roller 301A and the driven roller 301B. According to this configuration, the upper guide 401 will be pressed by the inner side in the bending direction of the sheet, but a similar effect as the first embodiment described above can be achieved.

Second Modified Example

Figure 6:
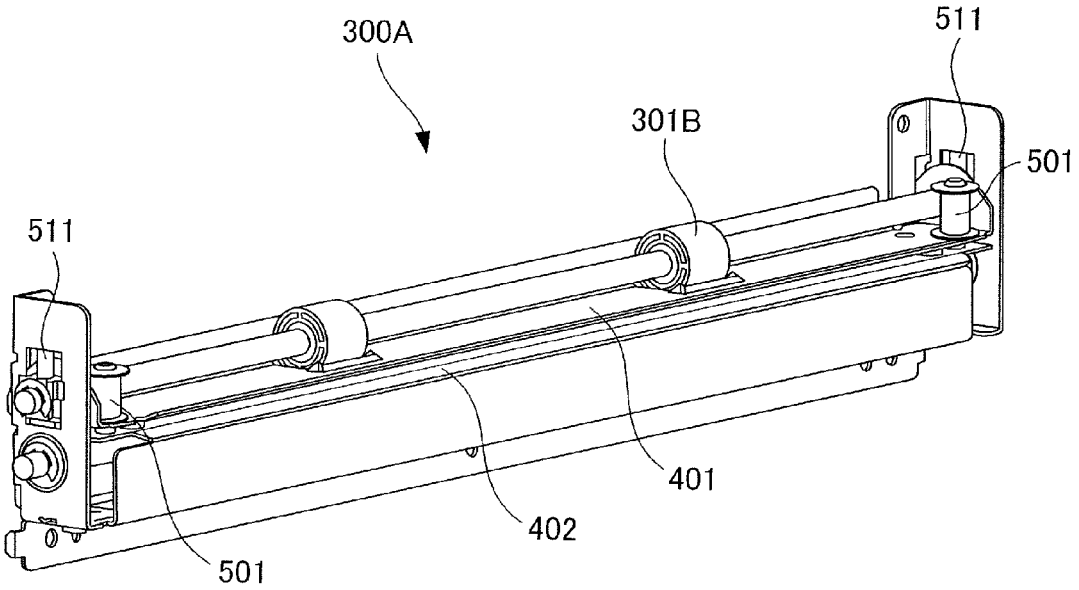
FIG. 6 is a perspective view of a roller unit according to a second modified example.

According to the first embodiment described above, the upper guide 401 is relatively rotatably supported by the drive shaft 302A of the drive roller 301A, but the present invention is not restricted thereto. That is, the arrangements of the drive roller 301A and the driven roller 301B of the roller unit 300A according to the first embodiment can be switched, as illustrated in FIG. 6. In that case, the driven roller 301B becomes the first rotary member, and the drive roller 301A becomes the second rotary member.

Figure 7A:
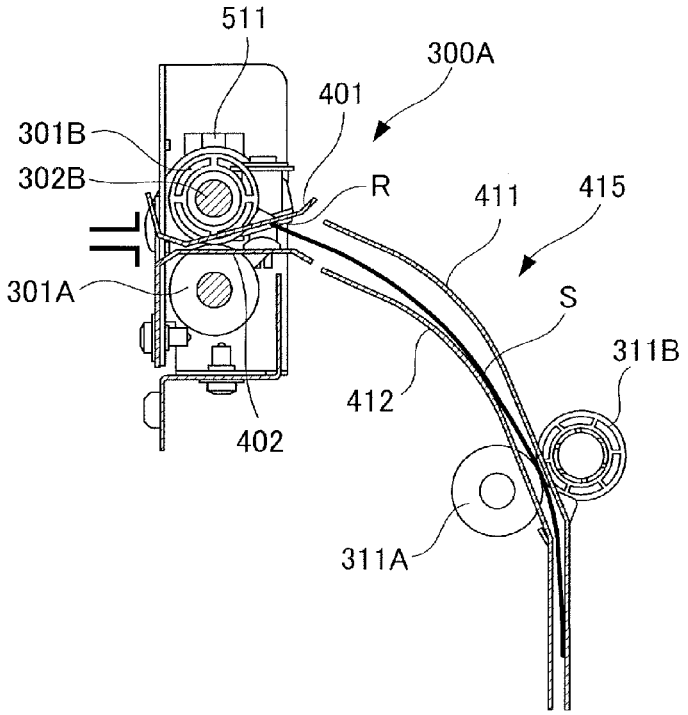
FIG. 7A is a cross-sectional view of a sheet conveyance apparatus according to a second modified example in a state where a bent conveyance guide is bent downward.
Figure 7B:
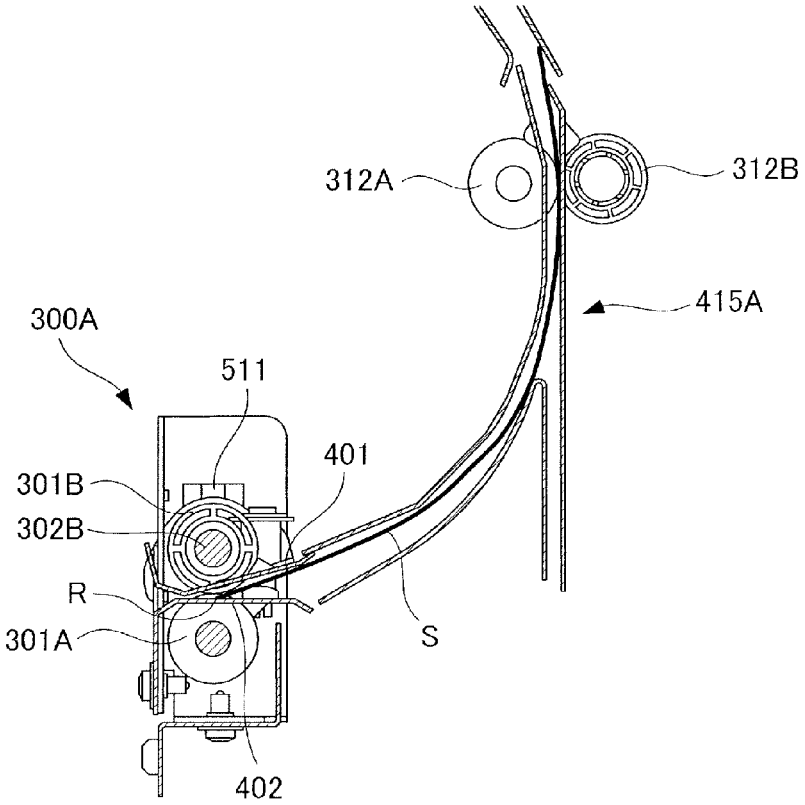
FIG. 7B is a cross-sectional view of a sheet conveyance apparatus according to a second modified example in a state where the bent conveyance guide is bent upward.

The bent conveyance guide pair arranged downstream in the sheet conveyance direction of the roller unit 300A having the above configuration can either be bent downward as illustrated in FIG. 7A or be bent upward as illustrated in FIG. 7B. However, according to the configuration illustrated in FIG. 7A, the stiffness of the sheet S causes the driven roller 301B biased toward the drive roller 301A to be pushed upward by the trailing edge R of the sheet S. In that case, the nip pressure between the drive roller 301A and the driven roller 301B is decreased. Therefore, it is preferable that the bent conveyance guide pair 415A is bent upward, as illustrated in FIG. 7B. In other words, when providing a swing guide on the side of the driven roller 301B, it is preferable to arrange the driven roller 301B on the inner side in the bending direction of the bent conveyance guide pair, so that the stiffness of the sheet S will not decrease the nip pressure of the drive roller 301A and the driven roller 301B.

As described, the bending direction of the bent conveyance guide pair, the arrangements of the drive roller and the driven roller, and the arrangement of the swing guide can each be selected arbitrarily in order to realize an optimum configuration. However, since the driven roller 301B is disposed relatively movably with respect to the drive roller 301A, the driven shaft 302B is provided movably. Therefore, the configuration in which the swing guide is provided on the side of the driven roller 301B with respect to the conveyance path is complex from the viewpoint of design. Therefore, the swing guide should be provided on the side of the drive roller 301A with respect to the conveyance path.

Second Embodiment

Now, a second embodiment of the present invention will be described, and according to the second embodiment, the upper guide adopts a different configuration as the first embodiment, so that similar configurations as the first embodiment will either be omitted in the drawing or assigned with the same reference numbers in the drawings and described.

Figure 8:
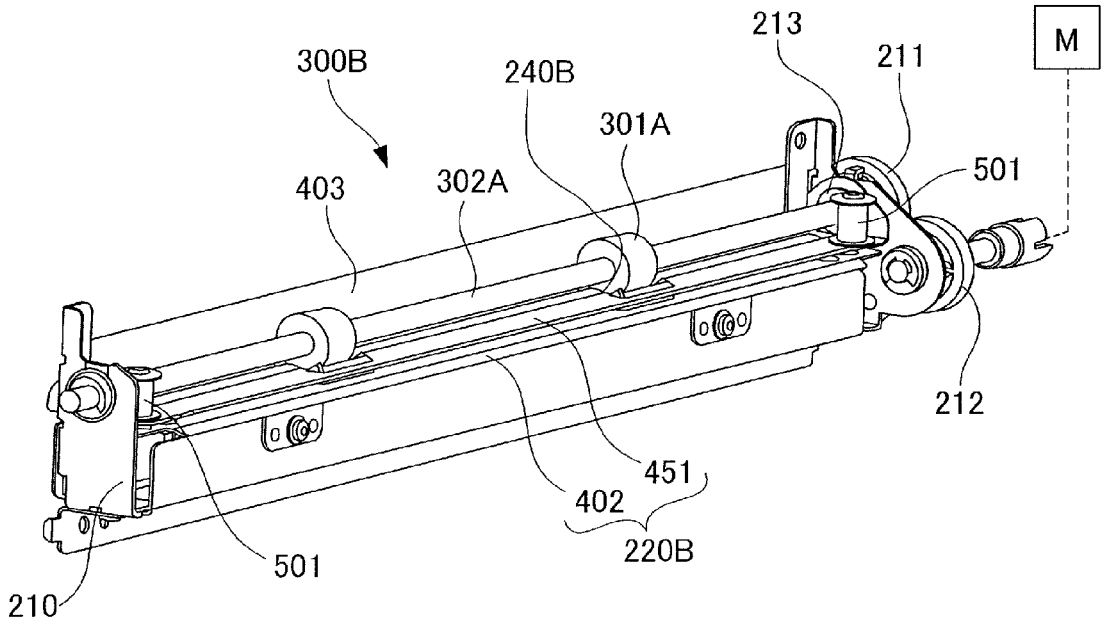
FIG. 8 is a perspective view of a roller unit according to a second embodiment.
Figure 9:
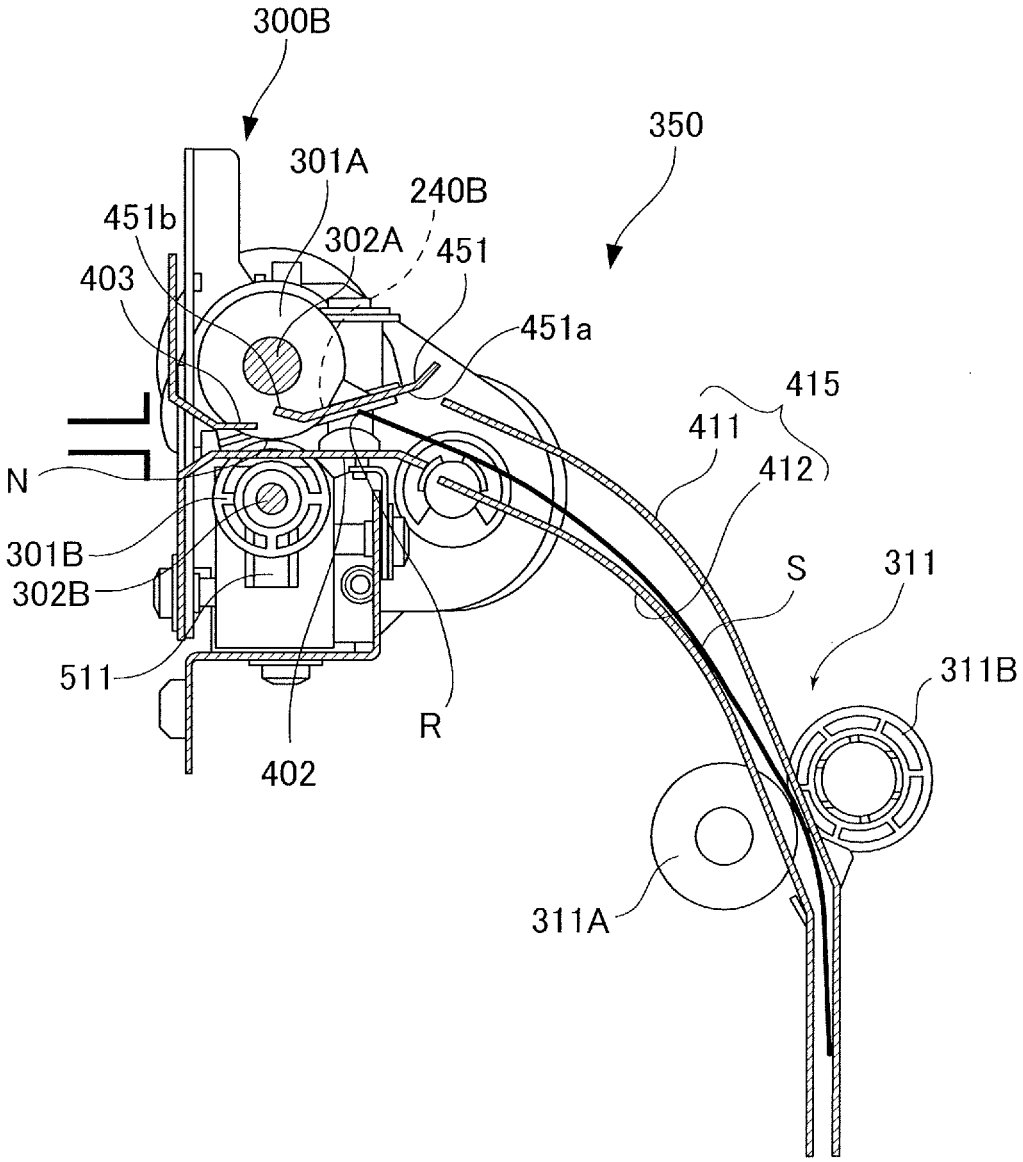
FIG. 9 is a cross-sectional view of a sheet conveyance apparatus in a state where the upper guide is swung.

As illustrated in FIGS. 8 and 9, the sheet conveyance apparatus 350 includes a roller unit 300B, a bent conveyance guide pair 415, and a downstream conveyance roller pair 311. The roller unit 300B includes a lower guide 402, an upper fixed guide 403 opposed to the lower guide 402, and an upper swing guide 451, i.e., swing guide.

The upper fixed guide 403 is fixed to the frame member 210, and arranged upstream of the nip N formed by the drive roller 301A and the driven roller 301B. The upper swing guide 451 is arranged downstream, in the sheet conveyance direction, of the nip N, and has a guide surface 451*a* that guides the sheets. The upper swing guide 451 has cutouts 240B, i.e., opening portions, through which a portion of the outer circumference surface of the drive rollers 301A protrude downward. The upper swing guide 451 is biased toward the lower guide 402 by the guide pressing member 501 described earlier, and retained by the guide gap regulation member 531.

Next, the conveyance operation of the sheets and the swing movement of the upper swing guide 451 will be described with reference to FIG. 9. It is assumed that a thick paper (having a basis weight of 300 g/m$^2$ or greater, for example) is used as the sheet S.

The sheet S fed via the attracting-conveying portion 201 is conveyed by the drive roller 301A and the driven roller 301B toward the bent conveyance guide pair 415. The sheet S is guided via the bent conveyance guide pair 415 to the downstream conveyance roller pair 311, and a trailing edge R of the sheet S passes the nip N. At this time, conveyance force is applied only from the downstream conveyance roller pair 311 to the sheet S. Since the sheet S is in a restrained state by the bent conveyance guide pair 415, conveyance resistance is increased.

Especially, when the trailing edge R of the sheet S passes the nip N, the trailing edge R of the sheet S that has become a free end presses the guide surface 451*a* of the upper swing guide 451 upward by the stiffness of the sheet S. The upper swing guide 451 swings upward by the pressing force, opposing to the biasing force of the guide pressing member 501. Thereby, the sheet S will have smaller curvature corresponding to the movement of the upper swing guide 451 swinging upward, and the increase of conveyance resistance caused by the stiffness of the sheet S can be reduced.

Moreover, the upper swing guide 451 is supported by the drive shaft 302A via the bearing 213 that allows relative rotation of the upper swing guide, and the upper swing guide 451 is arranged downstream in the sheet conveyance direction of the nip N. Therefore, the gap between the outer circumference surface of the drive roller 301A and the cutouts 240B formed on the upper swing guide 451 will not be varied greatly even when the upper swing guide 451 swings. The gap between the outer circumference surface of the drive rollers 301A and the cutouts 240B can be minimized, and jamming or damaging of the sheet caused by the sheet being caught in the gap can be prevented.

Further, an upstream end 451*b*, in the sheet conveyance direction, of the upper swing guide 451 is a portion of the upper swing guide 451 closest to the drive shaft 302A in the state where the upper swing guide 451 is retained by the guide gap regulation member 531. Therefore, since the upstream end 451*b* will not proximate the lower guide 402 even when the upper swing guide 451 swings upward, the opening of the upper swing guide 451 can be widened. Thereby, the curvature of the sheet S conveyed by the bent conveyance guide pair 415 can be reduced further, and the increase of conveyance resistance caused by the stiffness of the sheet S can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-147579, filed Jul. 27, 2015, which is hereby incorporated by reference herein in its entirety.

What is claimed is:

1. A sheet conveyance apparatus comprising:

a first conveyance unit configured to convey a sheet, the first conveyance unit comprising:

a first rotary member; and a second rotary member configured to contact with the first rotary member at a contact portion and convey the sheet in cooperation with the first rotary member;

a second conveyance unit arranged downstream, in a sheet conveyance direction, of the first conveyance unit, and configured to convey the sheet;

a bent conveyance guide configured to form a sheet conveying path between the first conveyance unit and the second conveyance unit such that the sheet conveying path is bent; and a swing guide provided upstream, in the sheet conveyance direction, of the bent conveyance guide, and configured to guide the sheet to the bent conveyance guide at a downstream side, in the sheet conveyance direction, of the contact portion, the swing guide comprising an opening portion defining an opening through which a part of the first rotary member protrudes toward the second rotary member, wherein a center of rotation of the swing guide is provided coaxially as a rotation axis of the first rotary member.

2. The sheet conveyance apparatus according to claim 1, further comprising an opposing guide opposed to the swing guide, wherein the swing guide is provided on an outer side, in a bending direction of the bent conveyance guide, with respect to the opposing guide.

3. The sheet conveyance apparatus according to claim 1, further comprising an opposing guide opposed to the swing guide, wherein the swing guide is provided on an inner side, in a bending direction of the bent conveyance guide, with respect to the opposing guide.

4. The sheet conveyance apparatus according to claim 1, further comprising an opposing guide opposing to the swing guide, wherein the swing guide swings by being pressed by the sheet such that a downstream end of the swing guide in the sheet conveyance direction moves away from the opposing guide.

5. The sheet conveyance apparatus according to claim 4, further comprising:

a biasing portion configured to bias the swing guide toward the opposing guide; and a retaining portion configured to be in contact with the swing guide and retain the swing guide with a predetermined gap between the swing guide and the opposing guide.

6. The sheet conveyance apparatus according to claim 1, wherein the swing guide is formed continuously from upstream to downstream, in the sheet conveyance direction, of the contact portion.

7. The sheet conveyance apparatus according to claim 1, further comprising a supporting portion rotatably supporting the first rotary member around the rotation axis, wherein the second rotary member is provided relatively movably with respect to the first rotary member.

8. The sheet conveyance apparatus according to claim 7, further comprising:

a driving source configured to drive the first rotary member; and a biasing member configured to bias the second rotary member with respect to the first rotary member.

9. The sheet conveyance apparatus according to claim 7, wherein the supporting portion comprises a restrict portion configured to contact with the swing guide and restrict a swing range of the swing guide.

10. The sheet conveyance apparatus according to claim 1, wherein the swing guide extends across the first rotary member in a width direction orthogonal to the sheet conveyance direction.

11. The sheet conveyance apparatus according to claim 1, further comprising:

a rotation shaft configured to rotatably support the first rotary member; and a bearing configured to swingably attach the swing guide to the rotation shaft.

12. An image forming apparatus comprising:

an image forming unit configured to form an image on a sheet; and a sheet conveyance apparatus configured to convey the sheet to the image forming unit, the sheet conveyance apparatus comprising:

a first conveyance unit configured to convey a sheet, the first conveyance unit comprising:

a first rotary member; and a second rotary member configured to contact with the first rotary member at a contact portion and convey the sheet in cooperation with the first rotary member;

a second conveyance unit arranged downstream, in a sheet conveyance direction, of the first conveyance unit, and configured to convey the sheet;

a bent conveyance guide configured to form a sheet conveying path between the first conveyance unit and the second conveyance unit such that the sheet conveying path is bent; and a swing guide provided upstream, in the sheet conveyance direction, of the bent conveyance guide, and configured to guide the sheet to the bent conveyance guide at a downstream side, in the sheet conveyance direction, of the contact portion, the swing guide defining an opening through which a part of the first rotary member protrudes toward the second rotary member, wherein a center of rotation of the swing guide is provided coaxially as a rotation axis of the first rotary member.

* * * * *